US005540335A

United States Patent [19]

Friedman

[11] Patent Number: 5,540,335

[45] Date of Patent: Jul. 30, 1996

[54] DISPLAY FOR A PLURALITY OF SEPARATE ITEMS

[75] Inventor: Howard B. Friedman, La Habra Heights, Calif.

[73] Assignee: Hartin International, Northridge, Calif.

[21] Appl. No.: 497,786

[22] Filed: Jul. 3, 1995

[51] Int. Cl.[6] ..... B65D 5/52; B65D 25/24

[52] U.S. Cl. ..... 206/756; 206/45.27; 206/767

[58] Field of Search ..... 206/745, 751, 206/756, 763, 45.24, 45.25, 45.27, 767, 768, 783, 775, 524.9; 211/57.1, 59.1; 248/174, 220.31, 222.51

[56] References Cited

U.S. PATENT DOCUMENTS 4,411,382 10/1983 Taub ..... 206/45.25
4,813,536 3/1989 Willis ..... 206/45.27
4,991,804 2/1991 Iannucci ..... 206/45.24
5,083,668 1/1992 Bushey ..... 248/220.31
5,375,725 12/1994 Rosenthal ..... 211/59.1

*Primary Examiner*—Jacob K. Ackun
*Assistant Examiner*—Nhan T. Lam
*Attorney, Agent, or Firm*—Jack C. Munro

[57] ABSTRACT

A display in the form of a sheet material carton which defines an internal compartment within which is located a mounting board. The mounting board includes a plurality of peg hook slots with a peg hook to be supportingly secured within each slot. On each peg hook is to be located, in an in line relationship, a stack of items to be displayed. The mounting board includes side flaps which are to be tightly held in position between top wall flaps attached to the carton and the sidewalls of the carton. The top wall flaps are also to include locking tabs which connect with appropriate locking tab openings formed within the mounting board and the carton. The carton also includes bottom wall flaps to be movable to a closed position when the display is being used.

6 Claims, 2 Drawing Sheets

DISPLAY FOR A PLURALITY OF SEPARATE ITEMS

BACKGROUND OF THE INVENTION

1) Field of the Invention

The subject matter of this invention pertains to point of purchase displays and in particular to a fold-up display carton which can be prepacked with the items that are to be displayed for shipment to the merchant where the display is to be utilized.

2) Description of the Prior Art

The retail sales industry has experienced a strong growth in recent years in point of purchase displays. This growth has been due primarily to marketing studies which has shown that point of purchase displays can result in increased sales of nearly four to one over conventional shelf displays.

Typically, a manufacturer and/or distributor of a particular line of products will provide the retailer not only with an attractively packaged product but also with a functional stand or rack which is designed to hold and contain the product that is to be sold and located in an orderly fashion and also to display the product in a pleasing, attention getting manner. Typically, these displays are manufactured expressly for the particular manufacturer and contain artwork and product information printed colorfully thereon expressly directed to the products which are displayed. These point of purchase displays are assembled and loaded with the prepackaged items to be displayed and then shipped to the retailer. The retailer then only needs to remove the display from its shipping carton and then with a minor amount of assembly, such as locating the display on a fold-up base, locate the display at a particular desired location on the floor of a store.

Such displays that are in common usage are normally constructed of a lightweight inexpensive material such as cardboard. The cardboard is to folded up into a rigid, planar structure containing attractive artwork and/or consumer information related to the products. Normally, these displays have an open top configuration that is used to contain and conveniently display the product to provide ease of selection of an item that is to be purchased by the purchaser. The display normally includes a plurality of support fixtures such as peg hooks which project outwardly with a plurality of items to be mounted on each peg hook. The items to be purchased are suspended from the peg hooks in an orderly tandem manner.

The use of prepacked displays have been found to significantly increase the profit of the product that is sold when contrasted with hand stocking procedures normally employed with conventional display shelves or merchant stocked display racks.

SUMMARY OF THE INVENTION

The primary objective of the present invention is to provide a point of purchase product display which is to be preassembled to a fold-up display stand and prepacked with product for shipment to the retailer and which can be placed in a condition of usage requiring only a minor amount of assembly by the retailer.

It is a further objective of the present invention to provide a display which, when assembled and prepacked with product, can be shipped to the retailer with the display able to withstand the rough handling that will naturally occur during shipment causing the display to arrive at the retailer in an attractive and sound appearance.

Another objective of the present invention is to provide a display that may be manufactured and assembled inexpensively, thereby minimizing the cost of utilizing such a display.

The display of this invention is to utilize a carton that has an internal compartment. Within that internal compartment is located a mounting board with a plurality of spaced apart slots being located within that mounting board. Each slot is to engage with a separate peg hook with a plurality of items that are to be displayed being mounted on each peg hook. The mounting board includes side flaps which are to be bound between the sidewalls of the carton and top wall flaps of the carton which are folded over in juxtaposition with the sidewalls. The top wall flaps include locking tabs which are to lockingly engage with locking tab openings that connect between the mounting board and the carton. The carton includes a closed bottom when the carton is utilized as a display.

DETAILED DESCRIPTION OF THE PREFERRED EMBODIMENT

Figures 1, 2, 3:
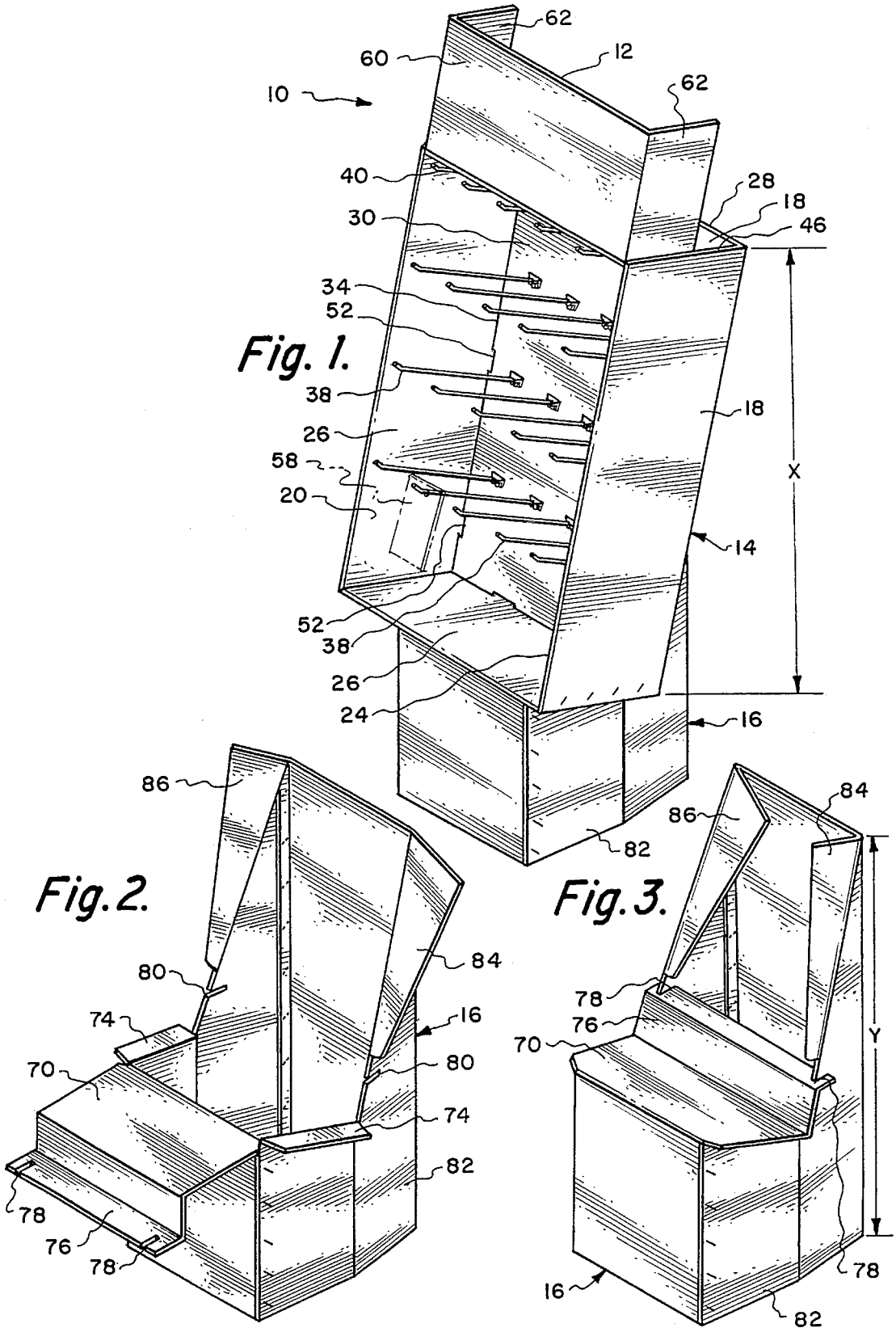
FIG. 1 is an isometric view of the assembled display of the present invention.
FIG. 2 is an isometric view of the base utilized to support the display carton of the display of the present invention showing the base in a partially assembled position.
FIG. 3 is an isometric view of the base showing the base in a completely assembled position.

Referring particularly to the drawings there is shown the display 10 which is composed of a header 12, a display carton 14, and a base 16. The display carton 14 is shown to be basically boxlike in configuration assuming a rectangular configuration. However, it is to be understood that it is within the scope of this invention that other configurations could be utilized such as for example a triangular or trapezoidal configuration. The display carton 14 is to be constructed of a rigid planar material with generally a cardboard being preferred. The display carton 14 is formed of four (in number) sidewalls 18 which are located in an encircling manner about an interior compartment 20. The sidewalls 18 are composed of two (in number) longer sidewalls and two (in number) of shorter sidewalls. However, it is to be understood that any desirable length of the individual sidewalls could be used. Because the enclosing sidewalls 18 form a basically rectangular shaped interior compartment 20, the longer sidewalls 18 are of the same length, and the shorter sidewalls 18 are also the same length.

Sidewalls 18 have a bottom edge 22 and a top edge 24. The top edge 24 is normally connected by means of a pair of double score lines to top wall flaps 26. The purpose of the double score lines at the top edge 24 is so that when the flaps 26 are folded inwardly in juxtaposition to the sidewalls 18, the double score lines of the top edge 24 assume a neat, attractive appearance that is non-sharpened. It is to be noted that there are two (in number) longer length top wall flaps 26 and two (in number) shorter length top wall flaps 26 with the shorter length flaps being of the same length and the longer length flaps also being of the same length. The width of each of the flaps 26 is essentially identical.

Integrally connected to the bottom edge 22 are bottom flaps 28. Again, there are two (in number) longer length bottom flaps 28 which are essentially similar in size to the longer length flaps 26 and there are two (in number) shorter length flaps 28 which are similar in size to the shorter length flaps 26. The flaps 28 Call be opened forming an access opening which is essentially the same size as the interior compartment 18. It is through this access opening that the mounting board 30 is to be inserted. The mounting board 30 includes a plurality of slots 32 located in a spaced apart manner. The actual number and location of the slots 32 is deemed to be a matter of choice. A typical arrangement of the slots 32 would be four rows of five slots 32 within each row. The mounting board 30 will also normally be constructed of a rigid material such as cardboard.

Figures 4, 5:
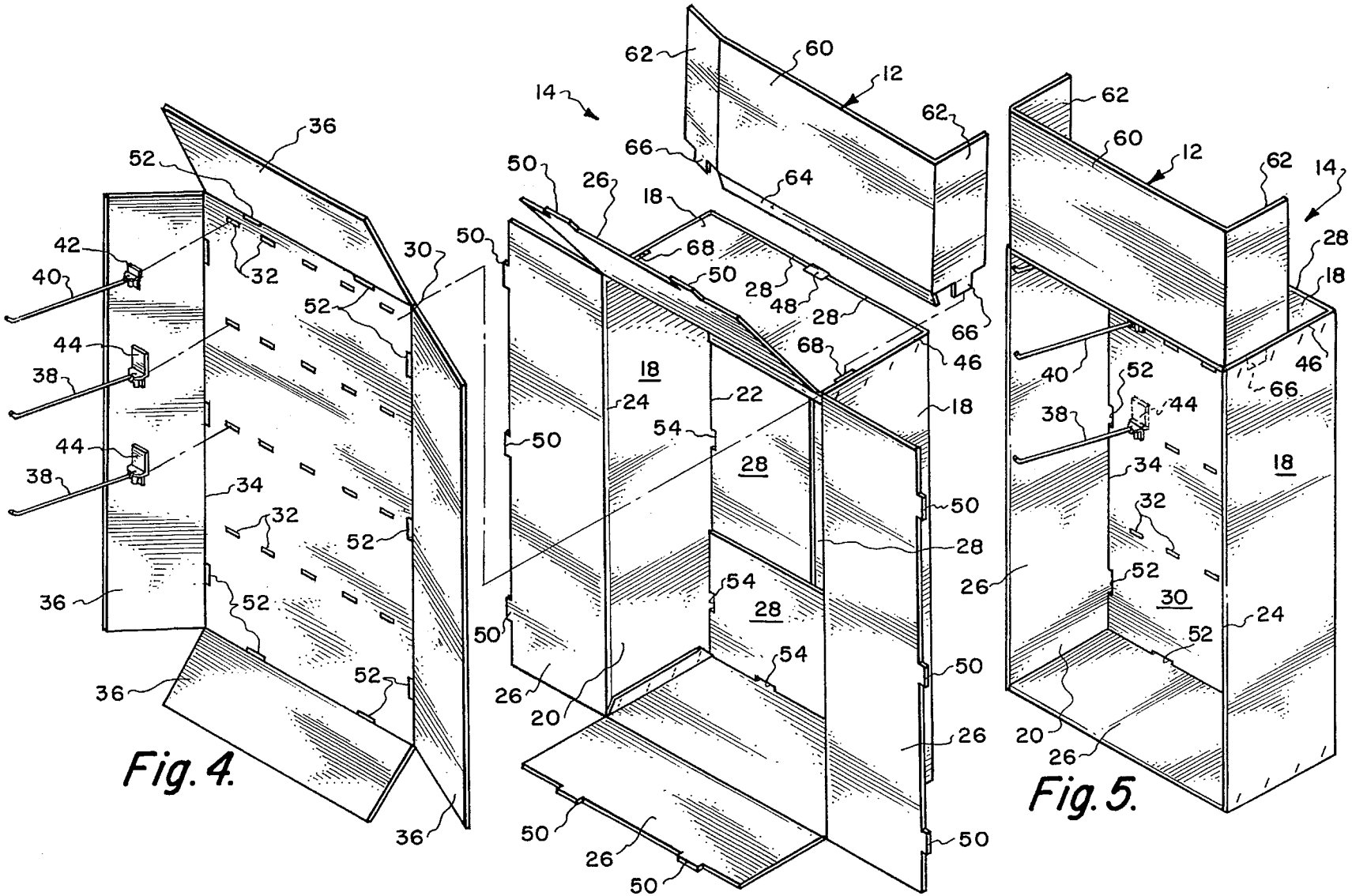
FIG. 4 is an exploded isometric view of the display carton and the header that is to be mounted on the carton showing such in an unassembled condition.
FIG. 5 is an isometric view of the display carton and the header showing such in the assembled condition.

Secured to the peripheral edge 34 of the mounting board 30 are four (in number) side flaps 36. Again, there are two (in number) longer length side flaps 36 and two (in number) shorter length side flaps 36. The side flaps 36 are all about the same width which is just slightly less than the width of the top wall flaps 26 and the width of the sidewalls 18. Top wall flaps 26 and sidewalls 18 are of the same width. The side flaps 36 are to be positioned at approximately a ninety degree angle to the mounting board 30 when the mounting board 30 is inserted into the interior compartment 20 through the access opening that is formed when the bottom wall flaps are positioned to be substantially in alignment with the sidewalls 18. The side flaps 36 are to be moved to be in alignment with and against the sidewalls 18 and when in that position, the bottom wall flaps 28 can then be closed in an overlaping arrangement as is clearly shown in FIG. 5 of the drawings. Once the bottom wall flaps 28 are closed, such are to be normally sealed as with a sealing tape 48.

At this particular time, peg hooks 38 and 40 are to be installed in conjunction with the mounting board 30. The only difference between the peg hooks 38 and 40 is that the peg hook 40 has a shorter heighth back plate 42 as compared to the back plate 44 of the peg hook 38. The row of the slots 32 that are located directly adjacent the top edge 46 have a limited amount of clearance that require the shorter length back plate 42 so as to not interfere with the sidewall 18 that is mounted at this top edge 46. This means that the peg hook 40 is only installed in this uppermost row with the remaining three rows of the slots 32 being able to accommodate the longer length back plate 44. The back plates 42 and 44 of their respective peg hooks 40 and 38 are to be slipped through their appropriate slots 32 and then pivoted forwardly assuming the installed position shown clearly in FIGS. 1 and 5 of the drawings. This will supportingly locate the position of peg hooks 38 and 40 on the mounting board 30.

Prior to installing of the peg hooks 38 and 40, the top wall flaps 26 are to be folded within the interior compartment 20. Each top wall flap 26 is in abutting juxtaposition with a side flap 36. As a result, each side flap 36 is tightly bound between a sidewall 18 and a top wall flap 26. This will securely hold in position the mounting board 30 within the interior compartment 20.

The side flaps 26 have outer edges which include a plurality of protuberances forming locking tabs 50. Each locking tab 50, when folded against its respective side flap 36, is to connect with a locking tab opening 52 formed within the mounting board 30. Each locking tab opening 52 also is in alignment with a locking tab opening 54 formed within the bottom edge 22. The engagement of the locking tabs 50 with the locking tab openings 52 and 54 will securely lock together the mounting board with the display carton 14 which will prevent the top wall flaps 26 from bowing outwardly during shipment of the display 10 to a retailer. The retailer only needs to remove the outer shipping carton (not shown) from the display 10 which will then expose the display carton 14 essentially in the position shown in FIG. 5 with the exception that the header 12 and base 16 are not mounted in position. When the retailer receives the display carton 14, the individually packed items 58 are already mounted on the peg hooks 38 and 40 in a tandem stacked arrangement. Typical items 58 would be kitchenware items such as bottle openers, knifes, cutters of different types, etc.

The header 12 is formed of a front panel 60 and side panels 62. The front panel 60 includes a bottom extension 64 which is to be folded over and located against the side panel 18 that is located at the top edge 46. The purpose of the extension 64 is to exert a small biasing force intending to keep the locking tabs 66 mounted on the lower edge of each side panel 62 securely engaged with its respective locking tab opening 68 which is formed at the top edge 46. Normally, the front panel 60 will be imprinted with appropriate words or other indicia which is to draw attraction to a consumer to intice the consumer to purchase the items 58. Also, the side panel 62 may include indicia.

The display carton 14 is to normally be mounted on a base 16 which is located in a folded up manner within the interior compartment 20 when it is received by the retailer. The base 16 is to be removed and open to the extended position shown in FIG. 2. In this position, the shelf 70 is to be pivoted approximately one hundred eighty degrees with the shelf 70 coming to rest on side flanges 74. Integrally connected with the shelf 70 is an L-shaped extension 76. Included within the L-shaped extension 76 are a pair of slots 78. These slots 78 are to connect with slots 80 formed within the body 82 of the base 16. The engagement of the slots 78 and 80 will securely hold in position the shape of the base 16 forming essentially a rigid structure. Flaps 84 and 86 are to be folded from the outer position shown in FIG. 2 to the inward position shown in FIG. 3 and are just to remain in that position. The display carton 14 is then to be located in a resting or setting position on the shelf 70. The back section of the body 82 is designed to be of a heighth Y as is shown in FIG. 3. Heighth Y is to be at least fifty percent of the overall heighth X of the display carton 14. The reason for the heighth Y is to provide adequate non-tipping support for the display carton 14 that is completely loaded with a substantial number of the items 58. A typical number of the items 58 within the display carton 14 would be approximately two hundred which can comprise a significant amount of weight which would normally result in ease of tipping of the carton 14. However, because the back section of the base 16 is of the desired height when compared to the height of the carton 14, adequate support is provided by the base 16 of the carton 14. Also, the carton 14 is supported in a more upright manner than within previous prior art displays even though the display carton 14 still assumes a slightly inclined position when mounted on the base 16.

What is claimed:

1. A display for a plurality of separate items comprising:

a carton having a plurality of sidewalls, said sidewalls being planar and encircling an interior compartment, said sidewalls having a top edge and a bottom edge;

a plurality of bottom wall flaps attached to said bottom edge, each said bottom wall flap being planar, said bottom wall flaps being movable between an open position and a closed position, said open position forming an access opening substantially the same size as said interior compartment, said closed position locating said bottom wall flaps in an overlapped relationship closing said access opening to the ambient;

a mounting board mounted in a close fitting manner within said internal compartment and located directly adjacent said bottom wall flaps, said mounting board having a peripheral edge, a plurality of side flaps attached to said mounting board at said peripheral edge with a said side flap to be located in abutting juxtaposition with a said sidewall; and a plurality of top wall flaps attached to said sidewall at said top edge, said top wall flaps to be located in abutting juxtaposition with said side flaps tightly securing said side flaps between said top wall flaps and said sidewalls; and said mounting board having a plurality of peg hook openings, each said peg hook opening to connect with a peg hook member, each said peg hook member to be able to support a plurality of items to be displayed.

2. The display as defined in claim 1 wherein:

each said peg hook opening comprising an elongated slot.

3. The display as defined in claim 1 wherein:

a plurality of first locking tab openings formed at said bottom edge, a plurality of second locking tap openings formed in said mounting board at said peripheral edge, a said second locking tap opening to align with a said first locking tab opening, said top wall flaps having locking tabs, each said locking tab to lockingly engage with an aligned series of said first and second locking tab openings thereby locking in position said top wall flaps with said mounting board and said carton.

4. The display as defined in claim 1 wherein:

said side flaps being substantially the same size.

5. The display as defined in claim 1 wherein:

said top wall flaps being four in number, said bottom wall flaps being four in number.

6. The display as defined in claim 1 wherein:

a base having a back section, said carton to be located on said base assuming an inclined position on said base, said back section being at least fifty percent of the height of said carton.

* * * * *